US006050417A

United States Patent [19]

Smith

[11] Patent Number: 6,050,417

[45] Date of Patent: Apr. 18, 2000

[54] CONTAINER ASSEMBLY FOR STORING AND SHIPPING SUBSTANTIALLY FLAT ARTICLES AND THE LIKE

[76] Inventor: Steven H. Smith, 2190 Keota La., Superior, Colo. 80027

[21] Appl. No.: 09/294,295

[22] Filed: Apr. 19, 1999

[51] Int. Cl.[7] ..... B65D 81/02

[52] U.S. Cl. ..... 206/521; 206/523; 206/594

[58] Field of Search ..... 206/521, 523, 206/583, 586, 594

[56] References Cited

U.S. PATENT DOCUMENTS

| | | | |
|---|---|---|---|
| 329,925 | 11/1885 | Markinsky . | |
| 1,445,762 | 2/1923 | Gerrard et al. . | |
| 1,890,467 | 12/1932 | McCarroll . | |
| 3,040,880 | 6/1962 | Acker . | |
| 3,266,705 | 8/1966 | Wood . | |
| 3,344,917 | 10/1967 | Raffet . | |
| 3,504,915 | 4/1970 | Walker . | |
| 3,511,990 | 5/1970 | Hauss . | |
| 3,780,487 | 12/1973 | Munson . | |
| 4,047,612 | 9/1977 | Lohmann | 206/586 |
| 4,784,269 | 11/1988 | Griffith | 206/586 |
| 4,848,542 | 7/1989 | Burnette et al. . | |
| 4,865,200 | 9/1989 | Sullivan et al. | 206/583 |
| 4,892,193 | 1/1990 | Thomas | 206/453 |
| 5,129,519 | 7/1992 | David et al. | 206/523 |
| 5,330,053 | 7/1994 | Tabuchi et al. | 206/594 |

*Primary Examiner*—David T. Fidei
*Attorney, Agent, or Firm*—Emery L. Tracy

[57] ABSTRACT

A container assembly for protecting corners, edges, and surfaces of at least one article when packaged in a box is provided. The device comprises a first panel member having a first surface and a second surface, a second panel member having a first surface and a second surface, a first cushioning member secured to the first surface of the first panel member, a second cushioning member secured to the first surface of the second panel member. A securing mechanism extending through the combined first panel member and the first cushioning mechanism, and the combined second panel member and the second cushioning mechanism for securing the combined first panel member and the first cushioning mechanism, and the combined second panel member and the second cushioning mechanism. The article is secured between the combined first panel member and the first cushioning mechanism, and the combined second panel member and the second cushioning mechanism.

20 Claims, 3 Drawing Sheets

CONTAINER ASSEMBLY FOR STORING AND SHIPPING SUBSTANTIALLY FLAT ARTICLES AND THE LIKE

BACKGROUND OF THE INVENTION

1. Field of the Invention

This invention related generally to a container assembly for storing and shipping substantially flat articles and, more particularly, it relates to a container assembly which protects the corners, edges, and surfaces of a variety of substantially flat articles, e.g., pictures, mirrors, and the like, during storing and shipping of the substantially flat articles.

2. Description of the Prior Art

When substantially flat articles are stored and/or shipped from one location to another, it is necessary to safely pack or crate the articles to inhibit damage to the substantially flat articles, e.g., dented edges, cracked frames, broken glass, etc. In many cases, such articles consist of pictures, mirrors, and a wide variety of other similar substantially flat articles. In the past, substantially flat articles such as those listed above, have been packaged in various different ways, but in most cases, such packaging devices and techniques have been unsatisfactory to inhibit damage and protect the article.

One technique used by many companies and other users to package various substantially flat articles has been to first wrap the substantially flat articles in material formed from paper or bubble wrap. The wrapped substantially flat articles are then placed in a box or a crate. The box or crate is then closed and sealed. Unfortunately, the described technique provides questionable protection of the substantially flat articles since the articles tend to move about within the box or crate thereby exposing the edges, the corners, and the surfaces of the articles to damage.

Another technique which has been utilized to package substantially flat articles has been to use pre-formed cushions of a resilient material, such as expanded polystyrene or rubber. The packing cushions are pre-formed in that the cushions are molded to conform to the contour of either the top or bottom, or both, of the article to be packaged. This technique permits the substantially flat article to be positioned, for example, in a bottom pre-formed cushion after which a top preformed cushion is positioned on top the substantially flat article. The substantially flat article is then enclosed and sealed within the box or crate thereby effectively sandwiching the article between the packing cushions within the box. Once again, unfortunately, the cushions fail to properly and effectively protect the edges, corners, and surfaces of the substantially flat articles when such substantially flat articles are stored or shipped.

There have been attempts in the prior art to improve the shortcomings in container assemblies for shipping and storing substantially flat articles. The Raffet, U.S. Pat. No. 3,344,917, describes a packaging for a plurality of panes or plates. The packaging of the Raffet patent includes two planar packaging elements or sheets with the panes emplaced therebetween, bound together by strapping, and encased in foam material. Overlapping tongues on each of the sheets attempt to maintain the panes in a substantially centralized location between the sheets. The strapping overlays the tongues to inhibit the strapping from contacting the panes. The entire foam wrapped package is then placed within a crate for shipping.

Unfortunately, the packaging of the Raffet patent has several deficiencies. First, it is questionable whether the Raffet patent's packaging properly secures the panes therein to inhibit movement of the panes. The overlapping tongues are only present on two sides of the panes thereby allowing the panes to shift in a direction generally perpendicular to the overlapping tongues. Second, the packaging of the Raffet patent is quite complicated and time consuming to assemble. Conservation of time in packing substantially flat articles is important to both professionals and other users who may have many different types of packing to accomplish in only a limited amount of time. Finally, the amount of material necessary to construct the Raffet patent's packaging substantially increases the costs of manufacturing the packaging which, in turn, increases the costs to the purchasing consumers.

Accordingly, there exists a need for a container assembly device for storing and shipping substantially flat articles. Additionally, a need exists for a container assembly for storing and shipping substantially flat articles and the like which protects the edges, corners, and surfaces of the substantially flat articles from damage. Furthermore, there exists a need for a container assembly for storing and shipping substantially flat articles and the like which is reusable and quick and easy to construct and utilizes a minimal amount of material to accomplish protection of the substantially flat articles.

SUMMARY

The present invention is a container assembly for protecting corners, edges, and surfaces of at least one article when packaged in a box. The device comprises a first panel member having a first surface and a second surface, a second panel member having a first surface and a second surface, first cushioning means secured to the first surface of the first panel member, and second cushioning means secured to the first surface of the second panel member. Securing means extend through the combined first panel member and the first cushioning means, and the combined second panel member and the second cushioning means for securing the combined first panel member and the first cushioning means, and the combined second panel member and the second cushioning means. The article is secured between the combined first panel member and the first cushioning means, and the combined second panel member and the second cushioning means.

In an embodiment of the present invention, the container assembly further comprises a first adhesive layer between the first cushioning means and the first side of the first panel member and a second adhesive layer between the second cushioning means and the first side of the second panel member.

In another embodiment of the present invention, the container assembly further comprises a plurality of first apertures extending through the combined first panel member and the first cushioning means, and a plurality of second apertures extending through the combined second panel member and the second cushioning means, the securing means extending through the first apertures and the second apertures. Preferably, the first apertures and the second apertures are arranged in a grid configuration.

In still another embodiment of the present invention the securing means is a cable tie. Preferably, the container assembly further comprises at least one washer mechanism positioned against the second surface of the first panel member and at least one washer mechanism positioned against the second surface of the second panel member, the securing means extending through the washer mechanisms.

In yet another embodiment of the present invention, the container assembly further comprises at least one spacer member between the first cushioning means and the second cushioning means. Preferably, the securing means extends through each of the spacer members.

In still yet another embodiment of the present invention, the first panel member and the second panel member are constructed from corrugated cardboard.

In another embodiment of the present invention, the first cushioning means and the second cushioning means are constructed from polyurethane.

The present invention further includes a method for protecting corners, edges, and surfaces of an article when packaged in a box. The method comprises providing a first panel member and a second panel member, securing first cushioning means to the first panel member thereby creating a first cushioned panel member, securing second cushioning means to the second panel member thereby creating a second cushioned panel member, positioning the article between the first cushioned panel member and the second cushioned panel member, and securing the first cushioned panel member and the second cushioned panel member.

In an embodiment of the present invention, the method further comprises providing a first adhesive layer between the first cushioning means and the first panel member and providing a second adhesive layer between the second cushioning means and the second panel member.

In another embodiment of the present invention, the method further comprises forming a plurality of first apertures extending through the first cushioned panel member, and forming a plurality of second apertures extending through the second cushioned panel member. Preferably, the method further comprises extending the securing means through the first apertures and the second apertures. Furthermore, preferably, the method further comprises forming the first apertures and the second apertures in a grid configuration.

In still another embodiment of the present invention, the method further comprises positioning at least one spacer member between the first cushioned panel member and the second cushioned panel member. Preferably, the method further comprises extending the securing means through each of the spacer members.

The present invention additionally includes a device for protecting a substantially flat article during storage and shipping with the article having a front surface, a back surface, and a peripheral edge. The device comprises cushioning means contacting the front surface and the back surface, maintaining means between the cushioning means and contacting the peripheral edge, and securing means for securing the cushioning means to the maintaining means wherein the article is maintained between the cushioning means during storage and shipping.

In an embodiment of the present invention wherein the cushioning means includes a first panel member and a first cushioning member contacting the front surface and a second panel member and a second cushioning member contacting the back surface.

In another embodiment of the present invention, the maintaining means includes at least one spacer member contacting the peripheral edge.

In still another embodiment of the present invention, the securing means includes a cable tie extending through apertures in the cushioning means and maintaining means.

BRIEF DESCRIPTION OF THE DRAWINGS

FIG. 1 is a sectional view illustrating a container assembly for storing and shipping substantially flat articles and the like, constructed in accordance with the present invention prior to insertion into a box or the like.

DETAILED DESCRIPTION OF THE PREFERRED EMBODIMENTS

Figure 1:
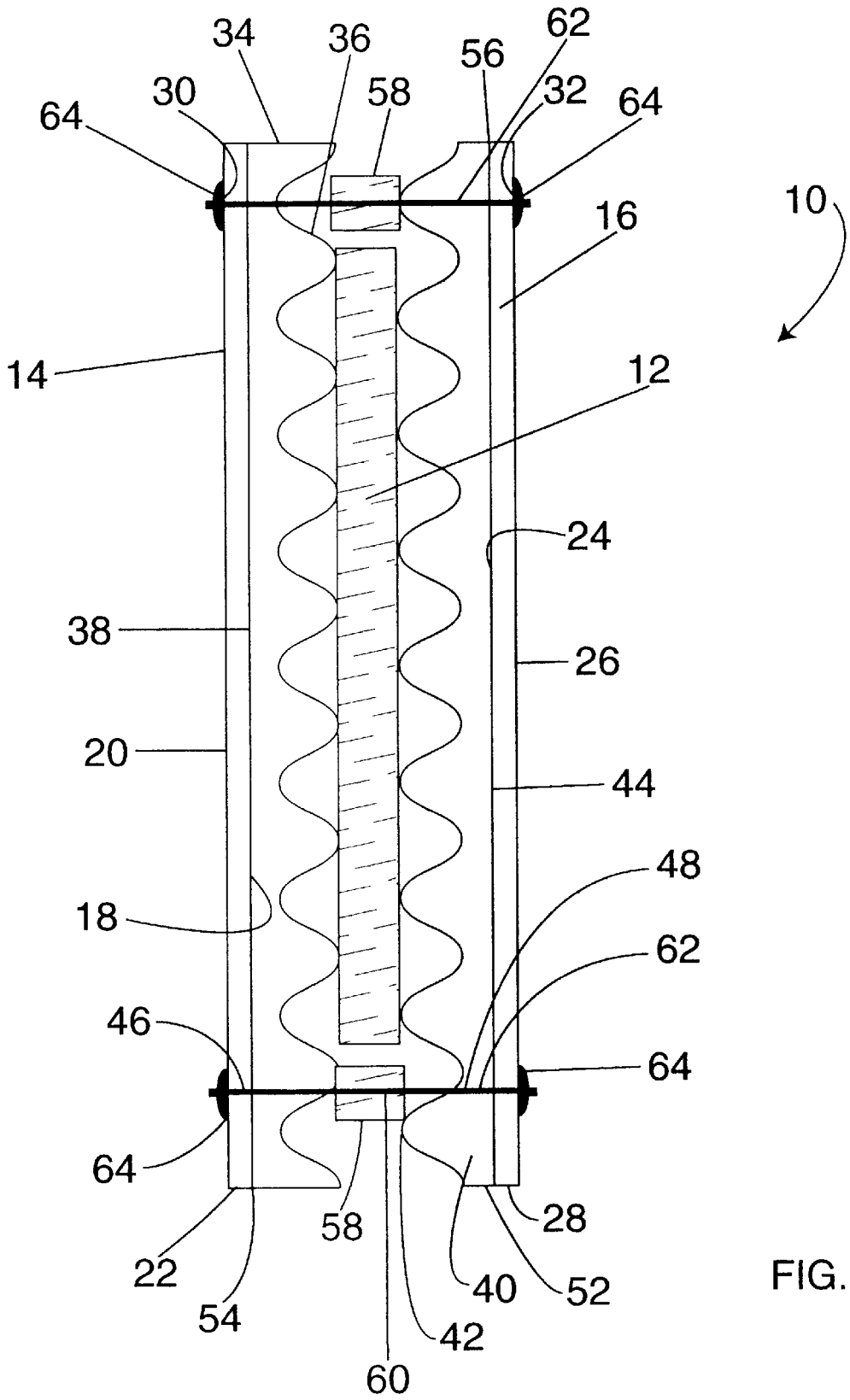
Figure 2:
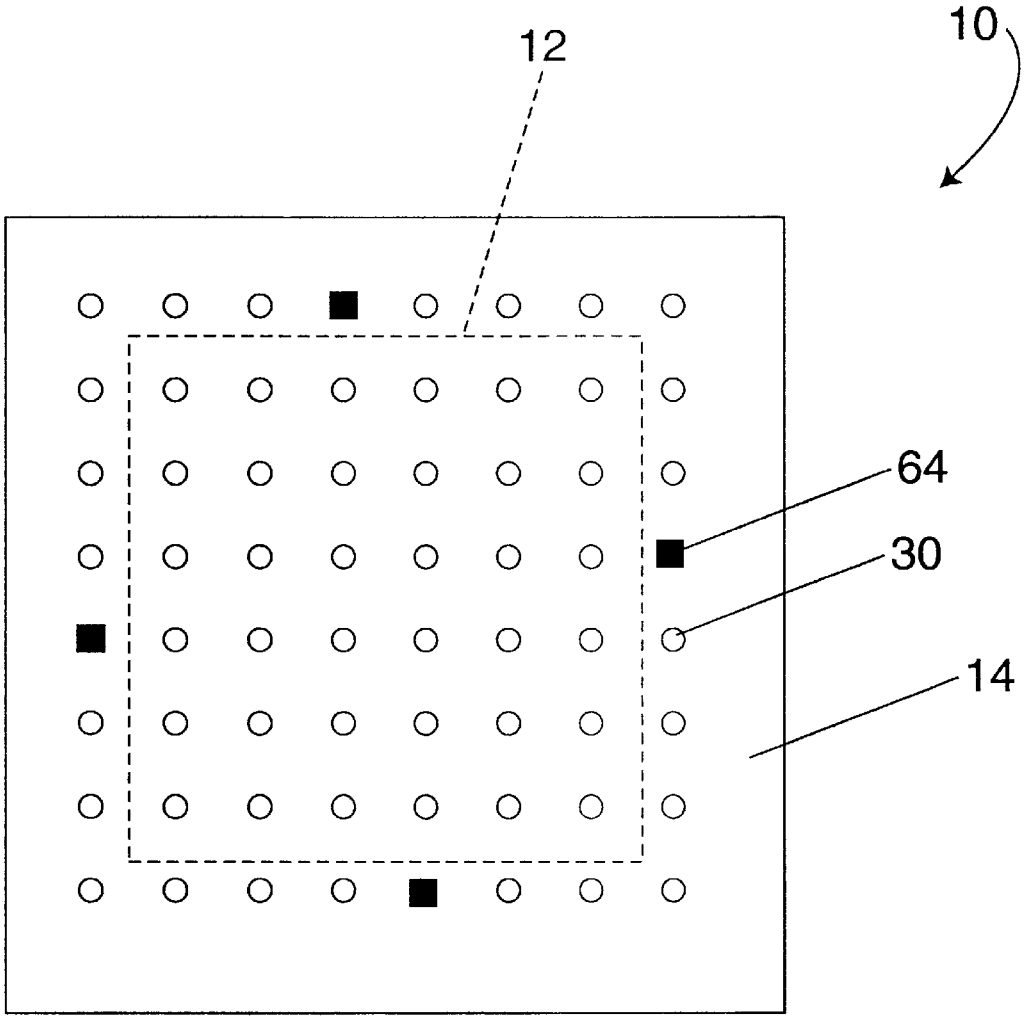
FIG. 2 is a top view illustrating a container assembly for storing and shipping substantially flat articles and the like, constructed in accordance with the present invention prior to insertion into a box or the like, and FIG. 3 is a top view illustrating a container assembly for storing and shipping substantially flat articles and the like, constructed in accordance with the present invention prior to insertion into a box or the like, with the container assembly holding multiple articles.

As illustrated in FIGS. 1 and 2, the present invention is a container assembly, indicated generally at 10, for storing and shipping substantially flat articles 12, e.g., pictures, mirrors, etc., within a box (not shown) and the like. The container assembly 10 protects the edges, the corners and/or the surfaces of the substantially flat articles 12 when placed in the box.

The container assembly 10 has a pair of substantially flat panel members, namely a first flat panel member 14 and a second flat panel member 16. The first flat panel member 14 has a first side surface 18, a second side surface 20 substantially opposite the first side surface 18, and an outside peripheral edge 22 surrounding the first side surface 18 and the second side surface 20. The second flat panel member 16 has a first side surface 24, a second side surface 26 substantially opposite the first side surface 24, and an outside peripheral edge 28 surrounding the first side surface 24 and the second side surface 26.

Preferably, both the first flat panel member 14 and the second flat panel member 16 are constructed from a substantially flat sheet of corrugated cardboard material. While the first flat panel member 14 and the second flat panel member 16 of the container assembly 10 of the present invention has been described heretofore and will be described hereafter as being formed from cardboard, it is within the scope of the present invention to form the first flat panel member 14 and the second flat panel member 16 from any substantially rigid material including, but not limited to, multiple layer corrugated cardboard, plastic, wood, fiberglass, metal, etc.

The first flat panel member 14 further includes a plurality of first panel apertures 30 (as also illustrated in FIG. 2) formed completely through the first flat panel member 14 from the first side surface 18 to the second side surface 20 of the first flat panel member 14. Furthermore, the second flat panel member 16 further includes a plurality of second panel apertures 32 formed completely through the second flat panel member 16 from the first side surface 24 to the second side 26 of the second flat panel member 16. Preferably, the first panel apertures 30 in the first flat panel member 14 and the second panel apertures 32 in the second flat panel member 16 are formed in a grid pattern (as illustrated in FIG. 2). In an embodiment of the present invention, the first panel apertures 30 and the second panel apertures 32 are formed in a three (3") inch grid pattern although forming the first panel apertures 30 and the second panel apertures 32 in a grid pattern greater than three (3") inches or forming the first panel apertures 30 and the second panel apertures 32 in a grid pattern less than three (3") inches is within the scope of the present invention.

As illustrated in FIG. 1, the container assembly 10 further has a pair of cushion members, namely a first cushion member 34 having a convoluted or eggshell-shaped top surface 36 and a substantially flat bottom surface 38 and a second cushion member 40 having a convoluted or eggshell-shaped top surface 42 and a substantially flat bottom surface 44. As will be described in further detail below, the substantially flat bottom surface 38 of the first cushion member 34 is secured to the first side surface 18 of the first flat panel member 14 and the substantially flat bottom surface 44 of the second cushion member 40 is secured to the first side surface 24 of the second flat panel member 16.

Like the first flat panel member 14 and the second flat panel member 16, the first cushion member 34 has a plurality of first cushion apertures 46 formed completely through the first cushion member 34 from the top surface 36 to the bottom surface 38 of the first cushion member 34. Furthermore, the second cushion member 40 further includes a plurality of second cushion apertures 48 formed completely through the second cushion member 40 from the top surface 42 to the bottom surface 44 of the second cushion member 40. Once again, preferably, the first cushion apertures 46 in the first cushion member 34 and the second cushion apertures 48 in the second cushion member 40 are formed in a grid pattern. In an embodiment of the present invention, the first cushion apertures 46 and the second cushion apertures 48 are formed in a three (3") inch grid pattern although forming the first cushion apertures 46 and the second cushion apertures 48 in a grid pattern greater than three (3") inches or forming the first cushion apertures 46 and the second cushion apertures 48 in a grid pattern less than three (3") inches is within the scope of the present invention.

The first cushion member 34 has a first peripheral edge 50 and the second cushion member 40 has a second peripheral edge 52. The dimensions of the first cushion member 34 and the second cushion member 40 are approximately equal to the dimensions of the first flat panel member 14 and the second flat panel member 16, respectively, such that the first peripheral edge 50 of the first cushion member 34 is substantially aligned with the outside peripheral edge 22 of the first flat panel member 14 and the second peripheral edge 52 of the second cushion member 40 is substantially aligned with the outside peripheral edge 28 of the second flat panel member 16. It should be noted, however, that it is within the scope of the present invention for the first cushion member 34 and the second cushion member 40 to have dimensions greater than the dimensions of the first flat panel member 14 and the second flat panel member 16, respectively, or for the first cushion member 34 and the second cushion member 40 to have dimensions less than the dimensions of the first flat panel member 14 and the second flat panel member 16, respectively.

Regardless of the dimensions of the first cushion member 34 and the second cushion member 40 relative to the dimensions of the first flat panel member 14 and the second flat panel member 16, respectively, at least one of the first panel apertures 30 is alignable with at least one of the first cushion apertures 46 and at least one of the second panel apertures 32 is alignable with at least one of the second cushion apertures 48. Actual construction of the container assembly 10 of the present invention and the utilization of the first panel apertures 30, the first cushion apertures 46, the second panel apertures 32, and the second cushion apertures 48 will be discussed in further detail below.

The first cushion member 34 and the second cushion member 40 are preferably formed from a polyurethane foam material which provides a cushioning effect for the substantially flat articles 12 within the container assembly 10. It is within the scope of the present invention, however, to form the first cushion member 34 and the second cushion member 40 from other types of padding material which provides the desired cushioning effect for the articles 12. Furthermore, the first cushion member 34 and the second cushion member 40 can be constructed in various thicknesses depending on the needs and desires of the user.

Still referring to FIG. 1, the container assembly 10 further has a first adhesive layer 54 between the bottom surface 38 of the first cushion member 34 and the first side surface 18 of the first flat panel member 14 to secure the first cushion member 34 to the first flat panel member 14 with at least one of the first panel apertures 30 aligned with at least one of the first cushion apertures 46. Furthermore, the container assembly 10 has a second adhesive layer 56 between the bottom surface 44 of the second cushion member 40 and the first side surface 24 of the second flat panel member 16 to secure the second cushion member 40 to the second flat panel member 16 with at least one of the second panel apertures 32 aligned with at least one of the second cushion apertures 48. Preferably, neither the first adhesive layer 54 nor the second adhesive layer 56 either covers or otherwise block the first panel apertures 30, the first cushion apertures 46, the second panel apertures 32, and the second cushion apertures 48. Furthermore, preferably, both the first adhesive layer 54 and the second adhesive layer 56 is a hot melt-type adhesive although other types of adhesive layers are within the scope of the present invention.

Additionally, the container assembly 10 of the present invention includes a spacer member 58 insertable between the top surface 36 of the first cushion member 34 and the top surface 42 of the second cushion member 40. The spacer member 58 includes a spacer aperture 60 alignable with the first panel apertures 30, the first cushion apertures 46, the second panel apertures 32, and the second cushion apertures 48. The spacer member 58 maintains a predetermined distance between the top surface 36 of the first cushion member 34 and the top surface 42 of the second cushion member 40 thereby allowing the article 12 to be inserted and firmly maintained therebetween.

The spacer member 58 is preferably formed from a polyethylene foam material which maintains the predetermined distance between the top surface 36 of the first cushion member 34 and the top surface 42 of the second cushion member 40 yet provides cushioning effect for protecting the edges of the substantially flat articles 12 within the container assembly 10. It is within the scope of the present invention, however, to form the spacer member 58 from other types of material which provides the desired effect for the articles 12.

The container assembly 10 of the present invention further includes at least one securing device or clamping assembly 62, e.g., a cable tie device, and at least one washer mechanism 64 (also illustrated in FIG. 2). Each washer mechanism 64 can be positioned against the second side surface 20 of the first flat panel member 14 and/or the second side surface 26 of the second flat panel member 16 with the securing device 62 being insertable through the washer mechanism 64, the first panel apertures 30, the first cushion apertures 46, the second panel apertures 32, and the second cushion apertures 48. Each securing device 62 is then securable to releasably maintain the substantially flat article 12 within the container assembly 10. While the securing device or clamping system 62 has been described as being a cable tie device, it is within the scope of the present invention to have any type securing device 62.

The operation of the container assembly 10 of the present invention will now be described in detail. Once again, it should be noted that while a particular construction and operation of the container assembly 10 will be described below, it is within the scope of the present invention to construct and operate the container assembly 10 in other manners.

As illustrated in FIG. 1, to operate the container assembly 10 of the present invention, first, the substantially flat article 12 is positioned within the container assembly 10 with the top surface 36 of the first cushion member 34 contacting one substantially flat side surface of the article 12 and the top surface 42 of the second cushion member 40 contacting the other substantially flat side surface of the article 12. Next, at least one spacer member 58 is positioned against each of the edges of the article 12. With a substantially rectangular article 12, it is desirable to use four (4) spacer members 58 with one space member 58 being positioned against each edge of the article 12 and aligned with one of the first panel apertures 30 and the first cushion apertures 46, and with one of the second panel apertures. 32 and the second cushion apertures 48. It should be noted that it is within the scope of the present invention to utilize more than four (4) spacer members 58, especially if the substantially flat article 12 to be protected by the container assembly 10 is substantially round, oval, or has more than four (4) edges, or to utilize less than four (4) spacer members 58, especially if the substantially flat article 12 to be protected by the container assembly 10 is triangular.

After the article 12 and the spacer members 58 have been positioned between the first cushion member 34 and the second cushion member 40, the washer mechanisms 64 are positioned against the second side surfaces 20, 26 of both the first flat panel member 14 and the second flat panel member 16, respectively, around the particular first panel aperture 30 and the particular second panel aperture 32, respectively, which are aligned with one of the spacer apertures 60 in one of the spacer members 58. The securing device 62 is then inserted through the washer mechanism 64 positioned against the first flat panel member 14, the first panel aperture 30, the first cushion aperture 46, the spacer aperture 60, the second cushion aperture 48, the second panel aperture 32, and the washer mechanism 64 positioned against the second flat panel 16. The securing device 62 is then secured to firmly secure the washer mechanisms 64, the combined first flat panel member 14 and first cushion member 34, the spacer member 58, and the combined second flat panel member 16 and the second cushion member 40 together while maintaining the substantially flat article 12 within the container assembly 10. The container assembly 10 and the article 12 are then positioned within a box or crate (not shown) for storage and shipment.

Figure 3:
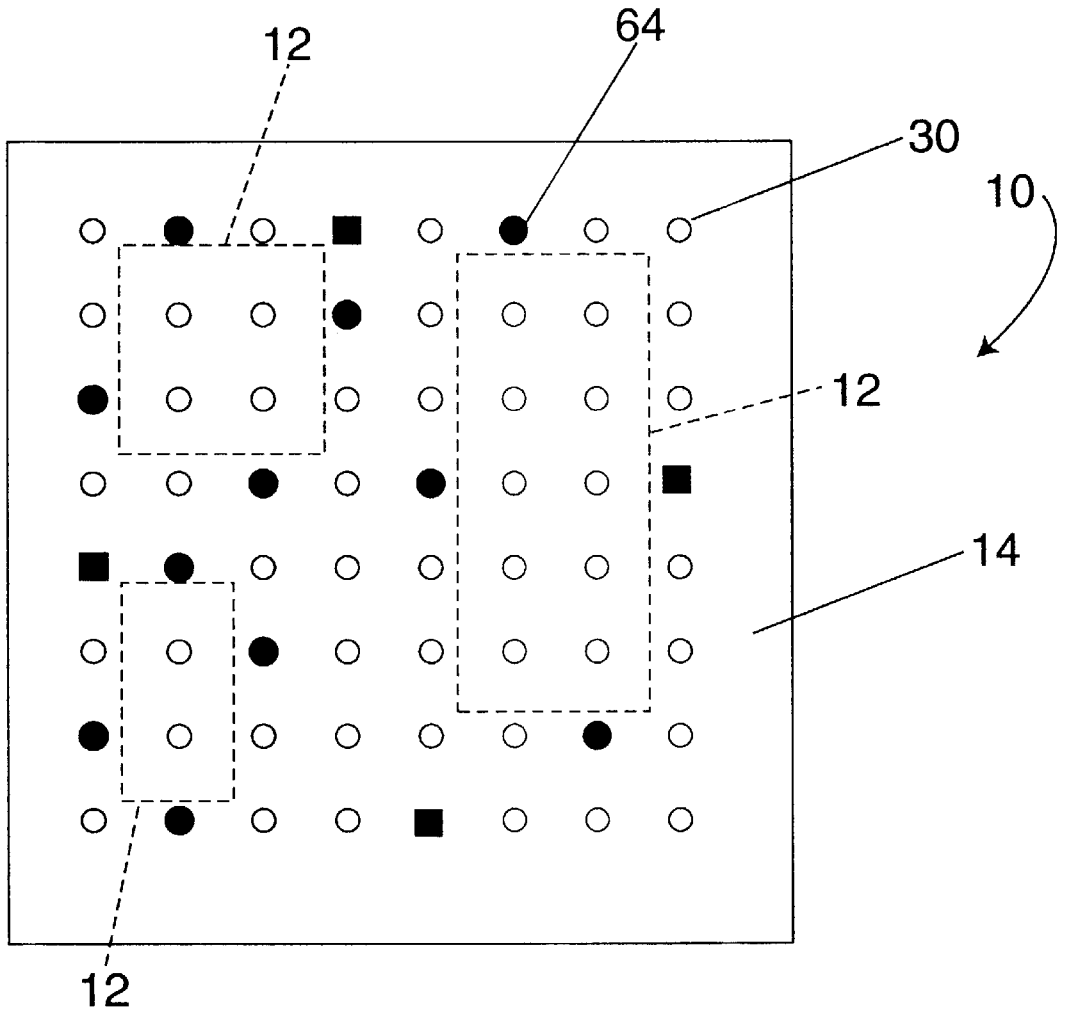

While the container assembly 10 of the present invention has been described as being useful for substantially flat articles, it will be evident to a person skilled in the art that the container assembly 10 can be used for all types and shapes of articles to be shipped. Furthermore, it will also be evident to a person skilled in the art that the container assembly 10 of the present invention can be used to store and ship multiple articles, as illustrated in FIG. 3, within the same container assembly 10. The multiple articles 12 can either be stored and shipped within the container assembly 10 in a side-by-side fashion or one article on top of another. If the latter is used, a foam layer can be inserted between the multiple articles 12 with the foam layer having apertures for receiving the securing device 62 similar to as described above.

The container assembly 10 of the present invention overcomes the shortcomings of the prior art with novel, low cost protection of substantially flat articles 12 during storage and shipping. The container assembly 10 provides unique, reusable, self-contained protection for substantially flat articles 12 when positioned within a box for storage and shipping. Furthermore, users of the container assembly 10 of the present invention can more quickly proceed with preparing the articles 12 within the container assembly 10 thereby decreasing packing time and costs.

The first panel member 14 and/or the second panel member 16 can include a flap (not shown) to fold over the first peripheral edge 50 of the first cushion member 34 and the second peripheral edge 52 of the second cushion member 40. The flap serves to additionally protect the articles 12 stored within the container assembly 10 when shipping the container assembly 10 within a bag, for instance, instead of a box or the like.

Furthermore, a high impact plastic polystyrene cover (not shown) can be mounted to either the second side surface 20 of the first panel member 14 and/or the second side surface 26 of the second panel member 16. The cover inhibits puncturing of the first panel member 14 and/or the second panel member 16 thereby furthering the protection of the articles 12 during storing and shipping of the container assembly 10.

Since the articles 12 are safely secured within the container assembly 10, regardless of the size of the article 12, and maintain their intended position within the container assembly 10, the container assembly 10 of the present invention safely protects the edges, corners and surfaces of the articles. Users of the container assembly 10 of the present invention have a degree of certainty that their substantially flat articles 12 can be stored and shipped without being destroyed or otherwise damaged.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A container assembly for protecting corners, edges, and surfaces of at least one article when packaged in a box, the device comprising:

a first panel member having a first surface and a second surface;

a second panel member having a first surface and a second surface;

first cushioning means secured to the first surface of the first panel member;

second cushioning means secured to the first surface of the second panel member;

securing means extending through the combined first panel member and the first cushioning means, and the combined second panel member and the second cushioning means for securing the combined first panel member and the first cushioning means, and the combined second panel member and the second cushioning means;

at least one first aperture formed through the combined first panel member and the first cushioning means; and at least one second aperture formed through the combined second panel member and the second cushioning means, each second aperture corresponding to one of the first apertures;

wherein the securing means extend through each of the first apertures and the corresponding second apertures thereby securing the article between the combined first panel member and the first cushioning means, and the combined second panel member and the second cushioning means.

2. The container assembly of claim 1 and further comprising a first adhesive layer between the first cushioning means and the first side of the first panel member and a second adhesive layer between the second cushioning means and the first side of the second panel member.

3. The container assembly of claim 1 and further comprising a plurality of first apertures and a plurality of second apertures wherein the first apertures and the second apertures are arranged in a grid configuration such that the container assembly can accommodate different sized articles and multiple articles in substantial planar relation to each other.

4. The container assembly of claim 1 wherein the securing means is a cable tie.

5. The container assembly of claim 4 and further comprising at least one washer mechanism positioned against the second surface of the first panel member and at least one washer mechanism positioned against the second surface of the second panel member, the securing means extending through the washer mechanisms.

6. The container assembly of claim 1 and further comprising at least one spacer member between the first cushioning means and the second cushioning means.

7. The container assembly of claim 6 wherein the securing means extends through each of the spacer members.

8. The container assembly of claim 1 wherein the first panel member and the second panel member are constructed from corrugated cardboard.

9. The container assembly of claim 1 wherein the first cushioning means and the second cushioning means are constructed from polyurethane.

10. A method for protecting corners, edges, and surfaces of a first article when packaged in a box, the method comprising:

providing a first panel member and a second panel member;

securing first cushioning means to the first panel member thereby creating a first cushioned panel member;

securing second cushioning means to the second panel member thereby creating a second cushioned panel member;

positioning the first article between the first cushioned panel member and the second cushioned panel member;

at least one spacer member positioned between the first cushioned panel member and the second cushioned panel member; and securing the first cushioned panel member and the second cushioned panel member.

11. The method of claim 10 and further comprising providing a first adhesive layer between the first cushioning means and the first panel member and providing a second adhesive layer between the second cushioning means and the second panel member.

12. The method of claim 10 and further comprising forming a plurality of first apertures extending through the first cushioned panel member, and forming a plurality of second apertures extending through the second cushioned panel member.

13. The method of claim 12 and further comprising extending the securing means through the first apertures and the second apertures.

14. The method of claim 12 and further comprising forming the first apertures and the second apertures in a grid configuration for receiving articles having various sizes.

15. The method of claim 10 and further comprising extending the securing means through each of the spacer members.

16. A device for protecting a substantially flat article during storage and shipping, the article having a front surface, a back surface, and a peripheral edge, the device comprising:

cushioning means contacting the front surface and the back surface;

maintaining means between the cushioning means and contacting the peripheral edge, the maintaining means including at least one spacer member contacting the peripheral edge; and securing means for securing the cushioning means to the maintaining means;

wherein the article is maintained between the cushioning means during storage and shipping.

17. The device of claim 16 wherein the cushioning means includes a first panel member and a first cushion member contacting the front surface and a second panel member and a second cushioning member contacting the back surface.

18. The device of claim 16 wherein the securing means includes a cable tie extending through apertures in the cushioning means and maintaining means.

19. The method of claim 14 and further comprising positioning at least one additional article between the first cushioned panel member and the second cushioned panel member, the first article and each additional article being substantially planar to each other.

20. The device of claim 16 and further comprising a plurality of apertures in the cushioning means and the maintaining means, such that the device can accommodate different sized articles and multiple articles.

* * * * *